US012677923B1

(12) United States Patent
Holman

(10) Patent No.: US 12,677,923 B1
(45) Date of Patent: Jul. 14, 2026

(54) BRAID REMOVAL DEVICE

(71) Applicant: Keith Holman, Belleville, IL (US)

(72) Inventor: Keith Holman, Belleville, IL (US)

( * ) Notice: Subject to any disclaimer, the term of this patent is extended or adjusted under 35 U.S.C. 154(b) by 335 days.

(21) Appl. No.: 18/538,180

(22) Filed: Dec. 13, 2023

Related U.S. Application Data

(60) Provisional application No. 63/432,252, filed on Dec. 13, 2022.

(51) Int. Cl.
*A45D 24/00* (2006.01)
*A45D 44/00* (2006.01)

(52) U.S. Cl.
CPC ..... *A45D 24/007* (2013.01); *A45D 2024/005* (2013.01); *A45D 44/00* (2013.01)

(58) Field of Classification Search
CPC ..... A45D 2024/005; A45D 2024/007; A45D 24/007; A45D 24/04; A45D 24/46; A45D 2002/003; A45D 2002/004; A45D 2002/006; A45D 2002/007; A45D 2002/008; A45D 2007/004; A45D 2007/005; A45D 44/00; A45D 2044/02; A45D 2044/04; A45D 2044/06; A46B 13/008; A46B 13/02
See application file for complete search history.

(56) References Cited

U.S. PATENT DOCUMENTS 431,497 A * 7/1890 Walker ..... A01K 13/002 15/23
2,303,089 A * 11/1942 Peterson ..... A01K 13/002 15/384
2,753,583 A * 7/1956 Jepson ..... A01K 13/002 15/23
3,431,571 A * 3/1969 Kraus ..... A46B 13/02 15/23
3,451,086 A * 6/1969 Burgett ..... A61C 17/3472 15/23
3,750,680 A * 8/1973 Miller ..... A45D 24/007 132/119.1
4,362,173 A * 12/1982 Blinman ..... A01K 13/002 119/632

(Continued)

FOREIGN PATENT DOCUMENTS

CA 2611605 A1 7/2009

OTHER PUBLICATIONS

Clarivate Analytics copyrighted translation of KR101989981B1; publication date Jun. 17, 2019 (Year: 2019).*

(Continued)

*Primary Examiner* — Edelmira Bosques
*Assistant Examiner* — Sarah Woodhouse
(74) *Attorney, Agent, or Firm* — John Rizvi; John Rizvi, P.A.—The Patent Professor®

(57) ABSTRACT

A braid removal device is disclosed for unraveling previously braided hair. The braid removal device includes a debraiding head assembly having a main body defining a space for receipt of a length of braided hair and a debraiding wheel rotatably mounted within the main body. The debraiding wheel includes a rotatable disk and a plurality of curved hook extending radially outwardly from the rotatable disk. A grip portion is removably attached to the debraiding head assembly and includes a motor to rotate the rotatable disk and a battery to power the motor.

20 Claims, 6 Drawing Sheets

(56) References Cited

U.S. PATENT DOCUMENTS

| | | | | |
|---|---|---|---|---|
| 5,701,920 | A | 12/1997 | Taylor et al. | |
| 6,021,783 | A | 2/2000 | Phillips | |
| 6,095,154 | A * | 8/2000 | Robinson | A45D 24/00 132/212 |
| 7,073,516 | B1 | 7/2006 | Beamen | |
| 8,479,749 | B2 | 7/2013 | Randolph | |
| 2003/0192564 | A1 * | 10/2003 | Johnson | A45D 24/007 132/148 |
| 2006/0096610 | A1 | 5/2006 | Bradford et al. | |
| 2007/0056602 | A1 | 3/2007 | Love-Johnson | |
| 2008/0230246 | A1 * | 9/2008 | Dollar-Wright | A45D 24/007 173/29 |
| 2011/0180013 | A1 * | 7/2011 | Kissel, Jr. | A46B 13/02 119/609 |
| 2013/0145992 | A1 * | 6/2013 | Liang | A47L 7/02 119/608 |
| 2013/0318729 | A1 * | 12/2013 | Suwanbutr | A46B 13/02 15/23 |
| 2015/0182000 | A1 * | 7/2015 | Grez | A46B 13/008 132/271 |
| 2018/0353368 | A1 | 12/2018 | Muhammad | |
| 2022/0167587 | A1 * | 6/2022 | Mogren | A01K 13/003 |

OTHER PUBLICATIONS

Clarivate Analytics copyrighted translation of DE3634232C1; publication date Dec. 17, 1987 (Year: 1987).*

* cited by examiner

BRAID REMOVAL DEVICE

CROSS-REFERENCE TO RELATED APPLICATION

This application claims the benefit of U.S. Provisional Patent Application No. 63/432,252, filed on Dec. 13, 2022, which is incorporated herein by reference in its entirety.

FIELD OF THE INVENTION

The present invention relates generally to braid removal devices, and more particularly, to a powered braid removal device for unraveling previously braided lengths of hair.

BACKGROUND OF THE INVENTION

Separating out hair into several bundles and weaving them into attractive and/or useful lengths of hair called braids is a centuries-old practice. Many different styles of braids exist including French braids, plaited, rope, etc. They all require time and skill to accomplish.

When a wearer no longer wishes to have their hair in braids, either to change a style or disassemble the hair forming the braids for cleaning, brushing, and other maintenance procedures, it is necessary to first unravel the hair bundles used to form the braids prior to brushing out the individual bundles into loose hair. This typically requires a separate person's aid to accomplish in a quick and efficient manner. When attempted alone, the wearer must reach around and try to pull apart the hair bundles often without being able to see them. This makes it difficult to unravel the braids.

Accordingly, there is need for a solution to at least one of the aforementioned problems. For instance, there is an established need for a braid removal device that a braid wearer can use by themselves to quickly and efficiently unravel braids into the bundles for subsequent hair brushing, washing, etc.

SUMMARY OF THE INVENTION

The present invention is directed to a braid removal device for unraveling previously braided hair. The braid removal device includes a debraiding head assembly having a main body defining a space for receipt of a length of braided hair and a debraiding wheel rotatably mounted within the main body. The debraiding wheel includes a rotatable disk and a plurality of curved hook extending radially outwardly from the rotatable disk. A grip portion is removably attached to the debraiding head assembly and includes a motor to rotate the rotatable disk and a battery to power the motor.

In an implementation of the invention, a braid removal device, for unraveling bundles of hair formed into a length of braided hair, comprises one or more debraiding head assemblies. Each debraiding head assembly may include a main body and a debraiding wheel. The main body may define a space for receipt of a length of braided hair. The debraiding wheel may include a rotatable disk and a plurality of curved hooks extending radially outwardly from the rotatable disk. The debraiding wheel may be rotatably mountable to the main body at least partially within the space of the main body such that the rotatable disk and the plurality of hooks are jointly rotatable with respect to the main body about a wheel rotation axis. The braid removal device may further include a driving assembly and a grip portion. The driving assembly may be configured to drive the debraiding wheel for rotation about the wheel rotation axis. The grip portion may be mountable to each debraiding head assembly of the one or more debraiding head assemblies. The braid removal device may be configured to adopt a working configuration in which the debraiding wheel is rotatably mounted to the main body of said each debraiding head assembly and the grip portion is mounted to the debraiding head assembly such that the grip portion carries said each debraiding head assembly and enables a handheld operation of said each debraiding head assembly by a user gripping the grip portion. In the working configuration, the length of braided hair may be positioned within the space of the main body of said each debraiding head assembly. In the working configuration, the driving assembly may be causing a rotation of the debraiding wheel of said each debraiding head assembly with respect to the main body about the wheel rotation axis, and the length of braided hair may be engaged by the plurality of hooks of the rotating, debraiding wheel to unravel the length of braided hair.

In another aspect, the grip portion includes a hollow outer housing and a motor having a drive shaft positioned within the hollow outer housing such that the drive shaft projects from the hollow outer housing, wherein the drive shaft is removably engageable with the debraiding wheel.

In another aspect, the debraiding wheel defines a drive bore for receipt of the drive shaft.

In another aspect, the grip portion includes a battery located within the hollow outer housing and connected to the motor.

In another aspect, the grip portion includes a plug on the hollow outer housing, the plug connected to the battery.

In another aspect, the braid removal device further includes a charging cord engageable with the plug and an external source of power to charge the battery.

In another aspect, the hollow outer housing is cylindrical.

In another aspect, the debraiding wheel further includes a central hub, the central hub defining the drive bore for receipt of the motor shaft.

In another aspect, the curved hooks are rigid.

In another aspect, the curved hooks are flexible.

In another aspect, the main body includes a first body portion and a second body portion, the first and second body portions defining the space therebetween.

In another aspect, the first and second body portions have concave inner surfaces.

In another aspect, the rotatable disk of the debraiding wheel has convex outer surfaces.

In another aspect, the curved hooks are removable from the rotatable disk.

In another aspect, the braid removal device further includes a second debraiding head assembly having a second main body defining a second space and a second debraiding wheel rotatably mounted within the second main body wherein the second debraiding wheel of the second debraiding head assembly differs from the debraiding wheel in the debraiding head assembly.

In a second implementation of the invention, a method for unraveling bundles of hair formed into a length of braided hair is provided, the method comprising:

providing a debraiding head assembly including a main body defining a space for receipt of a length of braided hair;

a debraiding wheel rotatably mounted within the main body, the debraiding wheel including a rotatable disk rotatable within the main body and a plurality of curved hooks extending radially outwardly from the rotatable disk, wherein the length of braided hair is positioned within the space in the main body and engaged by the rotating debraiding wheel to unravel the length of braided hair;

and a grip portion removably attached to the debraiding head assembly and including a motor for rotating the debraiding wheel within the main body;

positioning a length of braided hair in the space of the main body;

engaging intersections of individual bundles of hair forming the length of braided hair with the curved hooks; and rotating the debraiding wheel to rotate the curved hooks through the intersections of individual bundles of hair to unravel the length of braided hair.

In a second aspect, the method further includes providing a power source within the grip portion and energizing the power source to rotate the motor.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a braid removal device for unraveling or unbraiding a previously braided length of material such as, for example, a length of braided human hair.

Figure 1:
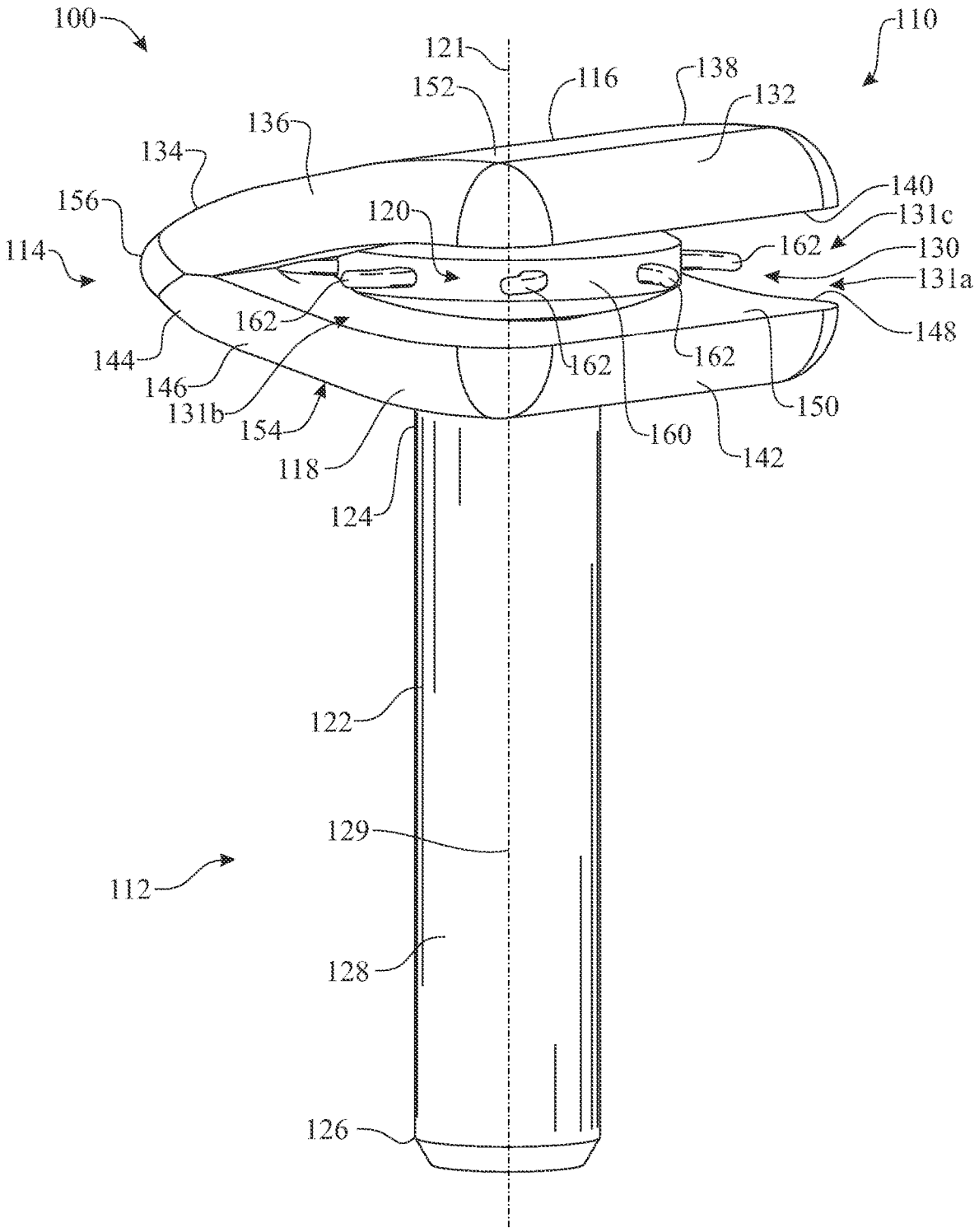
FIG. 1 presents a top front, left side isometric view of a braid removal device in accordance with an exemplary illustrative embodiment of the present invention.
Figure 2:
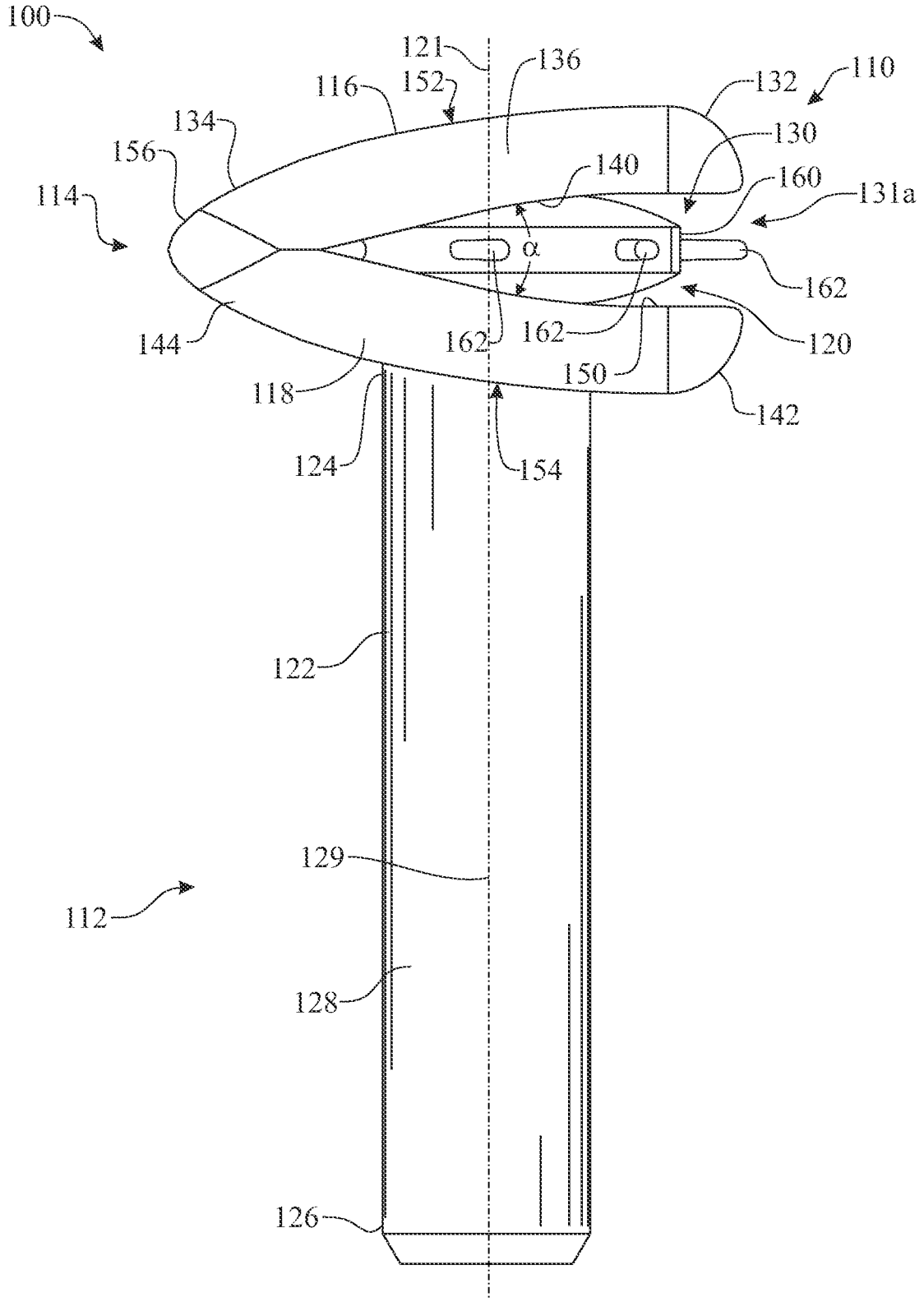
FIG. 2 presents a left side elevation view of the braid removal device illustrated in FIG. 1.

Referring to FIGS. 1-5, and initially with regard to FIGS. 1 and 2, a device for removing braids in a length of material, hereinafter braid removal device 100, is illustrated in accordance with an exemplary embodiment of the present invention. As shown, the braid removal device 100 generally includes a debraiding head assembly 110 for engaging and removing braids from hair and a grip portion 112, extending from the debraiding head assembly 110, for manipulating and controlling the debraiding head assembly 110.

The debraiding head assembly 110 includes a generally rectangular housing or main body 114 having a first body portion 116 and a second body portion 118 connected to the first body portion 116. The debraiding head assembly 110 further includes a debraiding wheel 120 removably and rotatably mounted within the main body 114. The main body 114 is provided to receive a length of braided material, such as, but not limited to, a length of braided human hair. The debraiding wheel 120 is rotatable within the main body 114 about a wheel rotation axis 121, to progressively unravel or de-braid the previously braided length of hair as discussed in more detail hereinbelow.

The grip portion 112 is provided to allow a user to manipulate the debraiding head assembly 110 over a length of previously braided hair. The grip portion 112 includes a cylindrical outer housing 122 having a first or top end 124, a second or bottom end 126 and an outer surface 128. The cylindrical outer housing 122 is formed along and about a central longitudinal axis 129. In preferred embodiments, the central longitudinal axis 129 is parallel to the wheel rotation axis 121, allowing the wheel rotation axis 121 to rotate about a plane which is perpendicular to the grip provided by the cylindrical outer housing 122; in such embodiments, the perpendicular positioning of the grip with respect to the debraiding wheel 120 may facilitate maneuvering the device without interfering with a braid passing therethrough and being untangled or debraided by the device. In more preferred embodiments, such as the present embodiment, the central longitudinal axis 129 of the grip or cylindrical outer housing 122 is the same as the wheel rotation axis 121 such that the debraiding wheel 120 rotates and is formed coaxially with the cylindrical outer housing 122; such configuration may facilitate a rapid, easy and intuitive positioning of the debraiding wheel 120 by maneuvering the grip or cylindrical outer housing 122.

The cylindrical outer housing 122 may be formed from a variety of materials such as, but not limited to, metallic materials stainless steel and aluminum, various polymers or plastics, etc. The outer surface 128 of the cylindrical outer housing 122 may be textured or otherwise treated to form a non-slip surface. Preferably, the materials used in the cylindrical outer housing 122 are easily cleaned and sterilizable for safety. The grip portion 112 additionally includes structure for powering the debraiding wheel 120 within the main body 114 of the debraiding head assembly 110 as discussed in more detail hereinbelow.

The debraiding head assembly 110 is removably mounted on the top end 124 of the cylindrical outer housing 122 of the grip portion 112. The main body 114 of the debraiding head assembly 110 forms a clamshell-like or clamshell-shaped structure for receiving a length of braided hair and guiding and positioning the braided hair relative to the debraiding wheel 120 of the debraiding head assembly 110. The clamshell-shaped structure is defined by the first and second body portions 116 and 118 defining a space 130 therebetween. The debraiding wheel 120 is arranged at least partially within the space 130 defined within the clamshell shaped main body 114, and more preferably, entirely within the space 130 such that the debraiding wheel 120 does not protrude outward of the space 130. The space 130 ends in a front opening 131*a* and further ends in opposite left and right side openings 131*b* and 131*c*, the openings 131*a*, 131*b* and 131*c* providing access to the space 130. The openings 131*a*, 131*b* and 131*c* the space 130 allow for positioning the length of braided hair within the debraiding head assembly 110.

As noted above, the main body 114 includes the first body portion 116 and the second body portion 118. In some embodiments, such as the present embodiment, the first and second body portions 116 and 118 may be formed as halves, i.e. may be generally shaped and sized the same and positioned symmetrical to one another, as shown. The first body portion 116 is generally rectangular having a leading or front end 132 and a trailing or rear end 134. The first body portion 116 includes first and second side edges 136 and 138, respectively, and an inner surface 140. Similarly, the second body portion 118 is also generally rectangular having a leading or front end 142 and a trailing or rear end 144. The second body portion 118 further includes first and second side edges 146 and 148, respectively, and an inner surface 150. The inner surfaces 140 and 150 of the first and second body portions 116 and 118, respectively, may be flat or slightly concave. The first and second body portions 116 and 118 also have outer surfaces 152 and 154.

The first body portion 116 and the second body portion 118 of the main body 114 define the space 130 therebetween. More specifically, the space 130 of the main body 114 may be defined by and between the inner surfaces 140 and 150. The front opening 131*a* of the main body 114 may be defined by the front ends 132 and 142. The left side opening 131*b* of the main body 114 may be defined by the first side edges 136 and 146, and the right side opening 131*c* of the main body 114 may be defined by the second side edges 138 and 148. Preferably the inner surfaces 140 and 150 of the first and second body portions 116 and 118 are oriented at an angle $\alpha$ of approximately 45° (FIG. 2). The first and second body portions 116 and 118 are joined together at their respective rear ends 134 and 144 by a rear connector 156. The first and second body portions 116 and 118 may be fixedly connected together or may be pivotally connected to each other at the rear connector 156 to allow for easier insertion and replacement of the debraiding wheel 120 within the main body 114. The main body 114, including the first and second body portions 116 and 118, respectively, may also be formed from a variety of metallic and/or polymeric/plastic materials.

As noted hereinabove, the debraiding head assembly 110 is removably attached to the grip portion 112 of the braid removal device 100. More specifically, the top end 124 of the cylindrical outer housing 122 releasably engages the outer surface 154 of the second body portion 118 of the main body 114. This allows a user to selectively and interchangeably attach various debraiding head assemblies 110, having differing main bodies 114 and/or differing debraiding wheels 120, to the grip portion 112 of the disclosed braid removal device 100.

Figure 6:
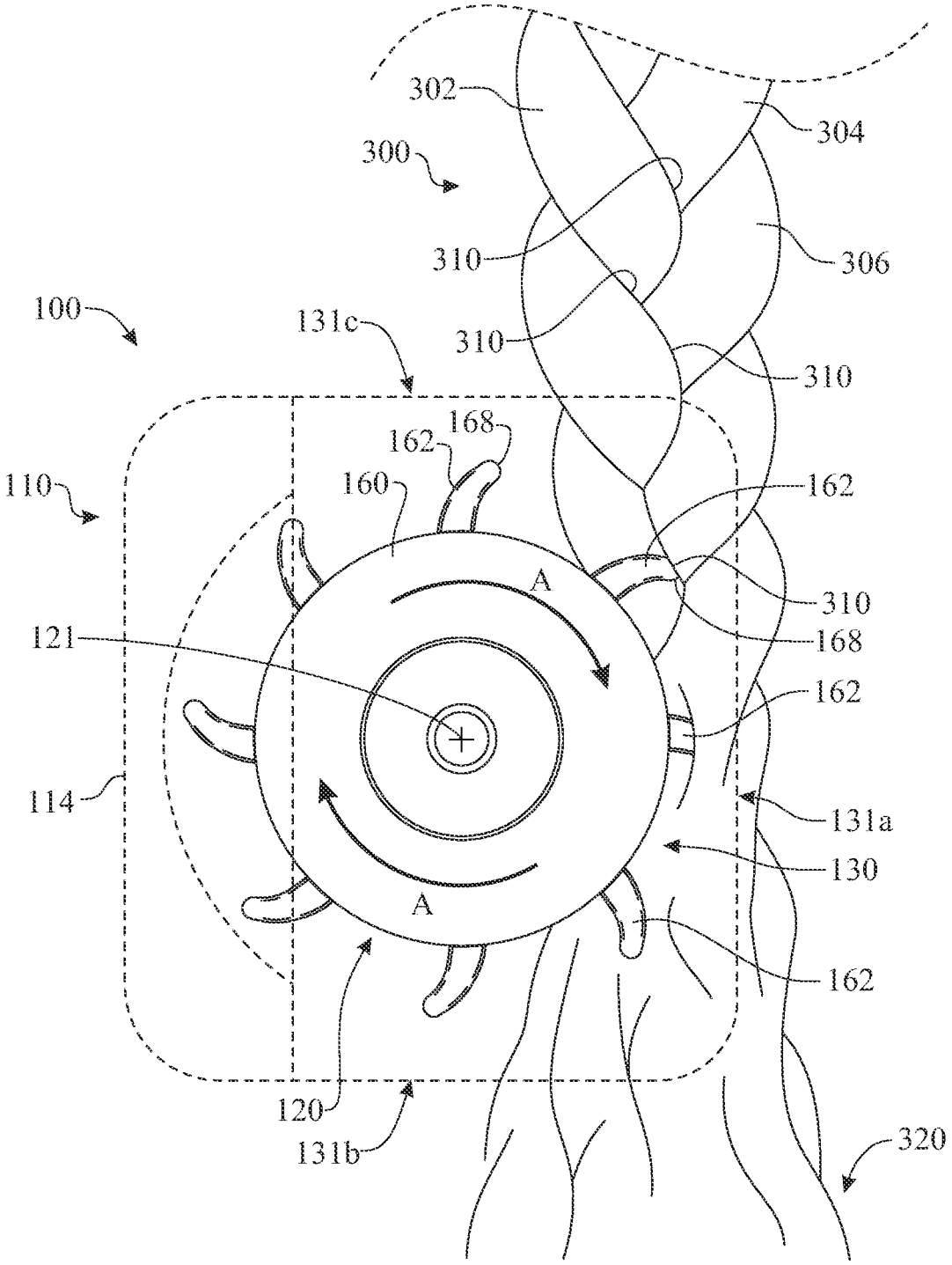
FIG. 6 presents a top plan view, partially shown in phantom, of the braid removal device of FIG. 1 in use to unravel a length of braided hair.

The debraiding wheel 120 of the debraiding head assembly 110 of the braid removal device 100 is provided to unravel a previously braided length of material such as, but not limited to, a length of braided hair. The debraiding wheel 120 is removably and rotatably mounted within the main body 114 and generally includes a circular rotatable disk 160 and a plurality of arched or curved fingers or hooks 162 extending radially outwardly from the rotatable disk 160. The curved hooks 162 may be curved in a same direction; for example, the curved hooks 162 of the present embodiment, with the rotatable disk 160 observed in top plan view as shown in FIG. 6, are curved in a clockwise direction. Rotation of the curved hooks 162, against a length of braided material positioned within the space 130 of the main body 110, serves to unravel the length of braided material as discussed in more detail hereinbelow. Said rotation of the curved hooks 162, which takes place jointly with the rotatable disk 160 about the wheel rotation axis 121, is preferably carried out in a same direction as that in which each curved hook 162 is curved (clockwise, in the present embodiment), thereby maximizing the unbraiding effect. The debraiding wheel 120 is removable from the main body 114 to allow a user to choose differing debraiding wheels having differing characteristics, such as, but not limited to, debraiding wheels 120 having curved hooks 162 of varying curvatures and stiffnesses or flexibility to suit particular conditions.

Figure 3:
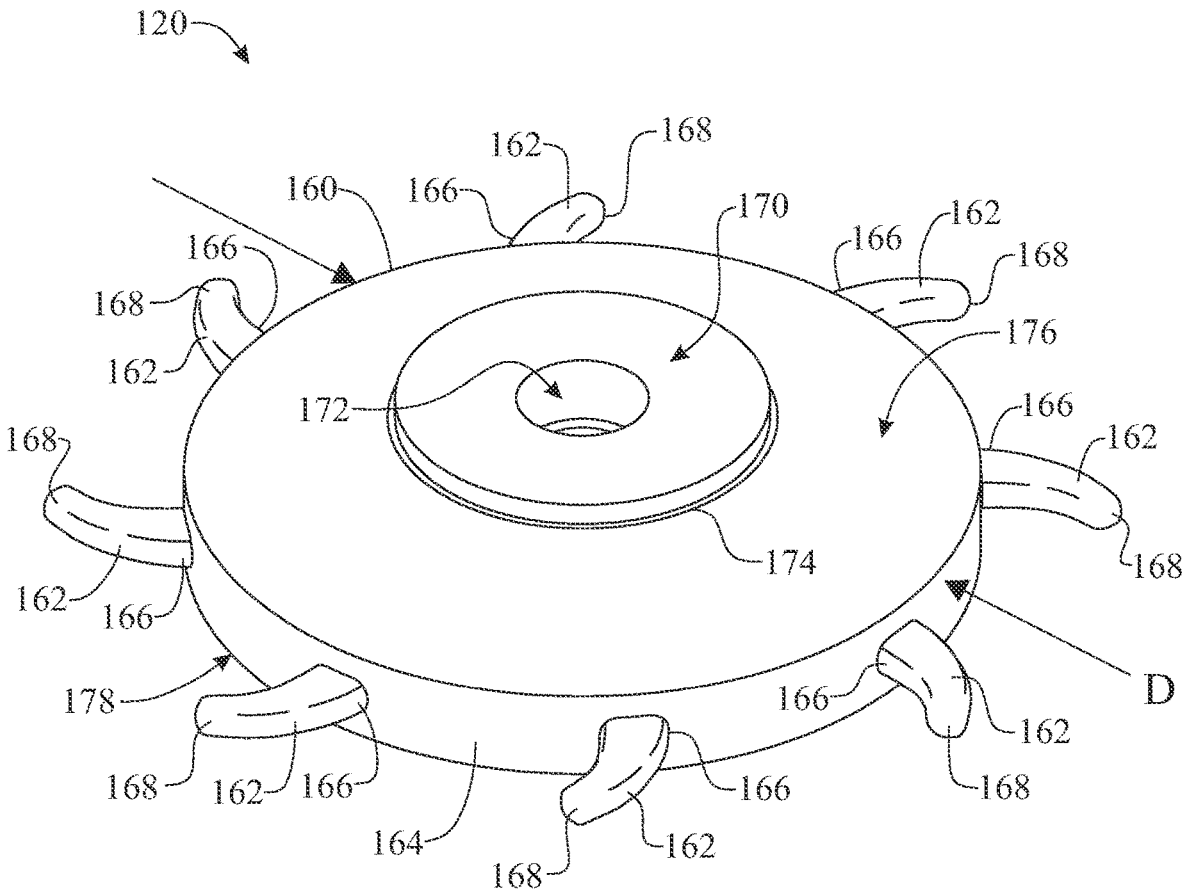
FIG. 3 presents a top isometric view of a debraiding wheel of the braid removal device.

With specific reference to FIG. 3, the rotatable disk 160 of the debraiding wheel 120 is circular having a diameter "D". The diameter D of the rotatable disk 160 may vary depending on the desired size of the debraiding wheel 120; in a non-limiting example, the diameter D may range from 2.0 to 2.5 inches. The rotatable disk 160 may be formed from a variety of metallic and/or polymeric/plastic materials.

The curved hooks 162 of the debraiding wheel 120 extend outwardly from a circumferential outer edge 164 of the rotatable disk 160. More specifically, the curved hooks 162 include inner ends 166 extending from the circumferential outer edge 164 of the rotatable disk 160 and free outer ends 168. The curved hooks 162 may be relatively rigid to allow the curved hooks 162 to unravel dense or tightly woven braids or may be slightly flexible for use in lightly braided material and/or to minimize any potential damage to the material being debraided.

The curved hooks 162 may be formed integrally with the rotatable disk 160 or may be formed separately from the rotatable disk 160 and attached to the circumferential outer edge 164 of the rotatable disk by various methods such as, but not limited to, gluing, welding, etc. Alternatively, the inner ends 166 of the curved hooks 162 may be individually threaded into the circumferential outer edge 164 of the man disk 160. This allows for easy replacement of an individual curved hook 162 in the event of damage or excessive wear.

In order to rotate the debraiding wheel 120 within the main body 114, the debraiding wheel 120 includes a central disk or hub 170 located centrally within the rotatable disk 160. The central hub 170 defines a bore 172, best shown in FIG. 3, for receipt of a drive element of the grip portion 112 as described in detail hereinbelow. The central hub 170 may be a separate part of the debraiding wheel 120 affixed within a bore 174 of the rotatable disk 160 or may be integrally formed with the rotatable disk 160.

With continued reference to FIG. 3, the rotatable disk 160 of the debraiding wheel 120 has an upper surface 176 and a lower surface 178. The upper and lower surfaces 176 and 178 of the rotatable disk 160 may be either flat or slightly convex, such as to conform to the concave inner surfaces 140 and 150 of the first and second body portions 116 and 118 of the main body 114 of the debraiding head assembly 110 (FIG. 2).

Figure 4:
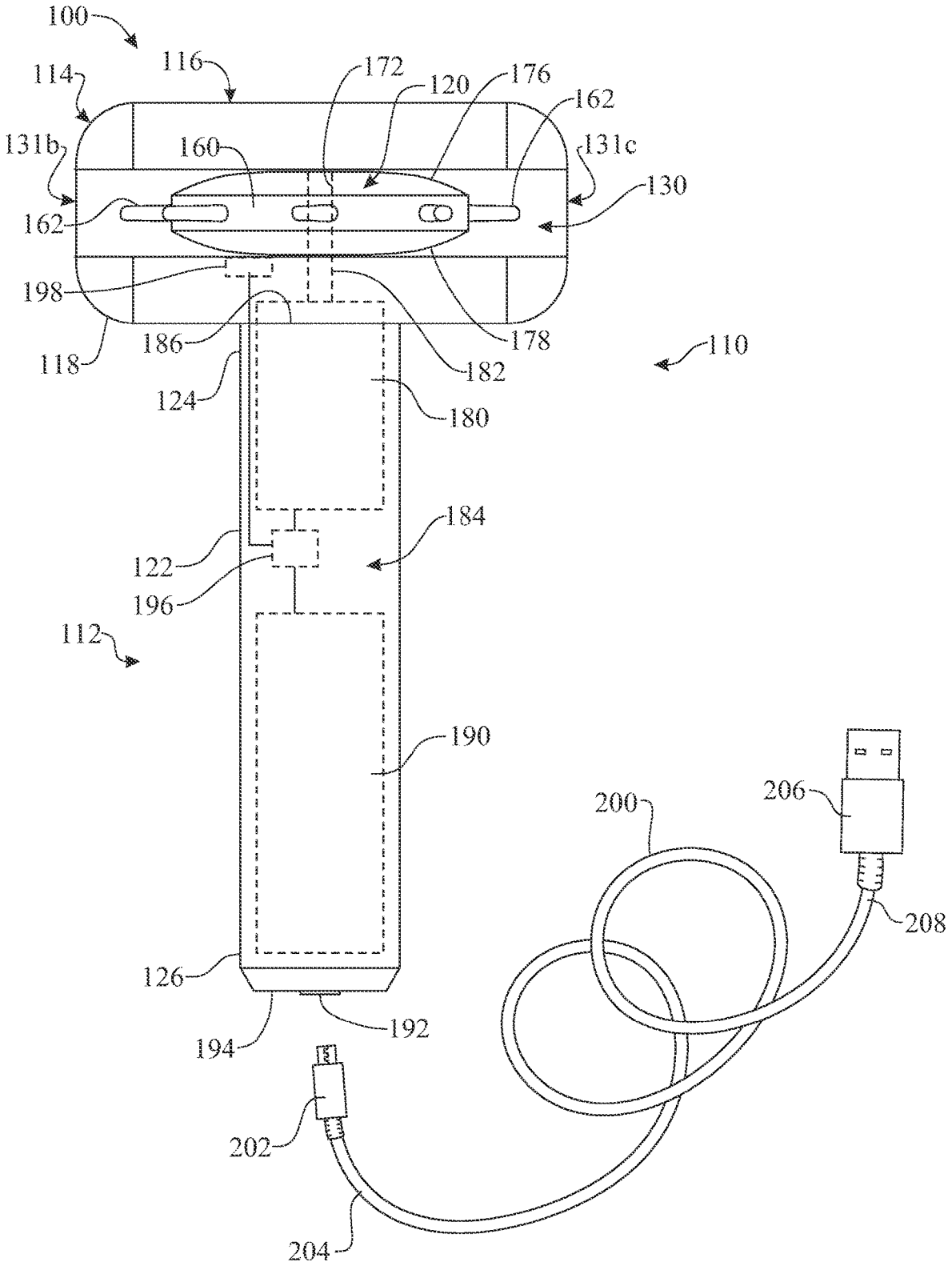
FIG. 4 presents a front elevation view of the braid removal device of FIG. 1 illustrating a motor and power system of the braid removal device, with internal components shown in hidden lines.

Referring now to FIG. 4, the grip portion 112 of the braid removal device 100 includes a motor 180 for rotating the debraiding wheel 120. The motor 180 is located within a hollow interior 184 of the cylindrical outer housing 122 of the grip portion 112 and has a drive shaft 182. The drive shaft 182 extends out of a top face 186 of the top end 124 of the cylindrical outer housing 122 and is engageable with the drive bore 172 in the central hub 170 of the debraiding wheel 120 in such a way that the drive shaft 182 is non-rotationally fitted within the drive bore 172 to rotate the debraiding wheel 120 within the main body 114. The motor 180 may be an alternating current (AC) motor connected to an external AC power source by a power cord (not shown) or may preferably be a direct current (DC) motor powered by an internal or external DC power source.

Preferably, the grip portion 112 further includes a rechargeable DC battery 190 located within the hollow interior 184 of the cylindrical outer housing 122 and electrically connected to the motor 180. A power jack 192 is provided in a bottom face 194 of the cylindrical outer housing 122 to connect the battery 190 to an outside power charging source (not shown). A power switch (also not shown) is provided to turn the power from the battery 190 to the motor 180 on and off. In a preferred embodiment, the power switch is a variable speed switch to allow a user to control the rate of rotation of the debraiding wheel 120 to better allow a user to unravel the braided material.

In some embodiments, a control unit 196 may controllably interface the motor 180 and the DC battery 190. The power jack 192 may further interface with the control unit 196 and/or directly with the DC battery 190. The control unit 196 may include, for instance and without limitation, one or more of a microprocessor, a microcontroller, or the like, hereinafter referred to generally as processor. In some embodiments, the control unit 196 may include a memory storing software instructions configured to cause the processor to operate the braid removal device 100 as herein described.

In some embodiments, the braid removal device 100 may include a tachometer, rotational speed sensor, or other sensor, hereinafter referred to generally as speed sensor 198, configured to measure the rotational speed of the motor shaft 182 or the disk 120. For instance, the speed sensor 198 may be located at the second body portion 118. The speed sensor 198 may interface with the control unit 196 to provide measurements or data informative of the speed of rotation of the motor shaft 182 and debraiding wheel 120 about the wheel rotation axis 121. In some embodiments, the control unit 196 may be configured to automatically stop the motor 180, responsively to the speed sensor 198 sensing a rotational speed of the debraiding wheel 120 lower than a predetermined threshold, for purposes described hereinafter.

In order to keep the battery 190 fully charged, the braid removal device 100 further includes a charging cord 200. The charging cord 200 includes plug 202 at a first end 204 of the charging cord 200 and a connector 206 at a second end 208 of the charging cord 200. The plug 202 of the charging cord 200 is releasably engageable with the power jack 192 in the cylindrical outer housing 122 of the grip portion 112. The connector 206 of the charging cord 200 is connectable to an outside source of power. In a preferred embodiment, the connector 206 is a USB type connector to connect the charging cord 200, and thus the battery 190, to any USB power outlet. In this manner, the battery 190 of the braid removal device 100 can be kept fully charged.

Figure 5:
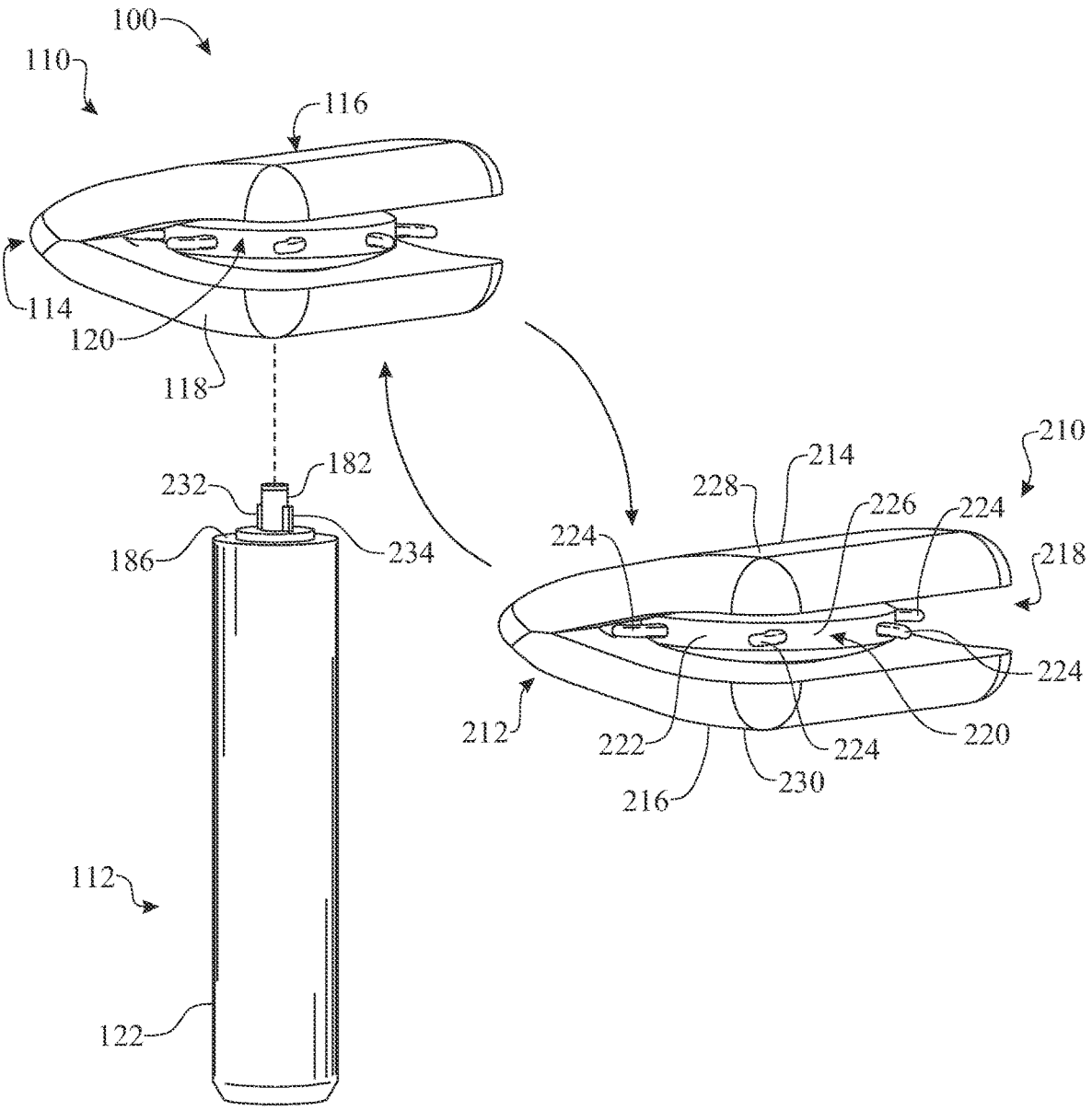
FIG. 5 presents a top front, left side isometric view of the braid removal device of FIG. 1, illustrating interchangeable debraiding head assemblies of the braid removal device.

Turning now for the moment to FIG. 5, and as noted hereinabove, the braid removal device 100 may be provided with various debraiding head assemblies, such as, but not limited to, debraiding head assemblies 110 and 210. The debraiding head assembly 210 is substantially similar to the debraiding head assembly 110 described hereinabove and generally includes a main body 212 having a first body portion 214 and a second body portion 216. The first and second body portions 214 and 216 define a space 218 therebetween. The debraiding head assembly 210 further includes a debraiding wheel 220 having a rotatable disk 222 with a plurality of curved hooks 224 extending radially outward from a circumferential outer edge 226 of the rotatable disk 222. The first and second body portions 214 and 216 includes outer surfaces 228 and 230, respectively. While not specifically shown, the debraiding wheel 220 further includes a central hub defining a bore for receipt of the drive shaft 182 of the motor 180. Side bars 232 and 234 extend from the top face 186 of the cylindrical outer housing 122 and engage corresponding slots (not shown) in the outer surface 216 of the second body portion 216 to prevent the second body portion 216 from rotating with the debraiding wheel 220. It should be noted that the outer surface 154 of the second body portion 118 of the debraiding head assembly 110 (FIG. 2) is provided with similar slots for receipt of the side bars 232 and 234.

The debraiding head assemblies 110 and 210 may differ in the stiffness, rigidity, and flexibility of the respective curved hooks 162 and 224. Alternatively or additionally, the diameters of the rotatable disks 160 and 222 of the respective debraiding wheels 120 and 220 may differ. Thus, a user can select the correct debraiding head assembly for the desired use.

Turning now to FIGS. 4-6, the use of the braid removal device 100 will now be described. Initially, as shown in FIG. 4, the battery 190 of the grip portion 112 of the braid removal device 100 is charged to full capacity by plugging the plug 202 of the charging cord 200 into the power jack 192 in the grip portion 112 and the connector 206 of the charging cord 200 into a suitable DC power source such as, but not limited to, a computer USB port or an AC adaptor.

Referring to FIG. 5, a desired debraiding head assembly, such as debraiding head assembly 110, debraiding head assembly 210 or another supplied debraiding head assembly having the desired characteristics, is chosen and attached to the grip portion 110. Specifically, the second body portion, for example second body portion 118, is positioned on the top face 186 of the cylindrical outer housing 122 and the drive shaft 182 of the motor 180 engaged with the drive bore 172 of the debraiding wheel 120 as heretofore described. Thus, the fully charged and assembled braid removal device is prepared for use.

Turning now to FIG. 6, the braid removal device 100 is designed to unravel braids in a length of braided material such as, but not limited to, length of braided hair 300. While the length of braided hair 300 may include hundreds of strands of hair, when braiding, the length of braided hair 300 is formed from, in this particular braid design, three individual hair bundles 302, 304 and 306 each of which contains many individual strands of hair.

In use, the length of braided hair 300 is initially inserted into the space 130 in the debraiding head assembly 110. For instance, as shown, the length of braided hair 300 may be inserted into the space 130 through the front opening 131*a* of the main body 114 and may extend outward of the space 130 through the left and right side openings 131*b* and 131*c*, and optionally through the front opening 131*a*. The length of braided hair 300 is pressed against the debraiding wheel 120 such that the curved hooks 162 engage or enter intersections 310 between adjacent hair bundles 302, 304 and 306. The braid removal device 100 can then be turned on to initiate rotation of the debraiding wheel 120 within the main body 114 about the wheel rotation axis 121.

As the debraiding wheel 120 rotates about the wheel rotation axis 121, the curved hooks 162 ride through the intersections 310 between the individual hair bundles 302, 304 and 306 to pull apart or unravel the hair bundles 302, 304 and 306 from each other. Preferably, the debraiding wheel 120 is rotated in a direction A (e.g., clockwise in the present embodiment) which causes the free outer end 168 of each curved hook 162 to be rotationally more advanced than the remainder of the curved hook 162 such that the free outer end 168 impacts first on the length of braided hair 300, promoting a penetration of the curved hook 162 into the intersections 310. During operation, the operator may exert a force on the length of braided hair 300 and/or the braid removal device 100 to cause a relative movement between the length of braided hair 300 and the debraiding head assembly 120 along a transverse direction B which generally matches a longitudinal direction of the length of braided hair 300, to promote unravelling of the hair. Such relative movement may be achieved, for instance, by pulling the length of braided hair 300 through the debraiding head assembly 120 while the debraiding wheel 120 is rotating, causing the length of braided hair 300 to advance along the openings 131*a*, 131*b* and 131*c* and the space 130; alternatively or additionally, said relative movement may be achieved by sliding the braid removal device 100 along the length of braided hair 300. The relative movement is facilitated by the grip or cylindrical outer housing 122 being elongately formed generally perpendicularly to the debraiding wheel 120 (i.e. by the rotation axes 121, 129 being parallel to one another, and more preferably, matching one another as heretofore described). In this manner, the disclosed braid removal device 100 quickly and conveniently unravels braids of individual hairs 320. The now unbraided hair bundles 302, 304 and 306 may be brushed, combed, or otherwise handled to pull the bundles out into individual lengths of hair 320. Alternatively, the braid removal device 100 can subsequently be used to separate out the hair bundles 302, 204 and 306 into loose hair 320.

In some embodiments, the speed sensor 198 may monitor the speed of rotation of the debraiding wheel 120 and the drive shaft 182 during operation of the motor 180, and may provide measurements or data informative of the sensed speed of rotation to the control unit 196. Should the sensed speed of rotation fall below the predetermined threshold, the control unit 196 may automatically stop the motor 180. In this way, the speed sensor 198 may detect that the debraiding wheel 120 encounters a knot or entanglement in the length of braided hair 300 and may responsively stop the motor 180 to allow the operator to then easily and rapidly remove the length of braided hair 300 through the openings 131*a*, 131*b* and/or 131*c* and manually untangle the hair. Once the length of braided hair 300 is untangled, operation of the braid removal device 100 may be resumed as heretofore described.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A braid removal device for unraveling bundles of hair formed into a length of braided hair, the braid removal device comprising:

one or more debraiding head assemblies, each debraiding head assembly comprising:

a main body defining a space for receipt of a length of braided hair, and a debraiding wheel, comprising a rotatable disk and a plurality of curved hooks extending radially outwardly from the rotatable disk, the debraiding wheel rotatably mountable to the main body at least partially within the space of the main body such that the rotatable disk and the plurality of hooks are jointly rotatable with respect to the main body about a wheel rotation axis;

a driving assembly, configured to drive the debraiding wheel rotationally about the wheel rotation axis; and a grip portion, mountable to each debraiding head assembly of the one or more debraiding head assemblies;

wherein during use, the braid removal device is configured to adopt a working configuration in which each debraiding wheel of the one or more debraiding head assemblies is rotatably mounted to the main body of a respective one of the one or more debraiding head assemblies and the grip portion is mounted to each debraiding head assembly such that the grip portion carries each debraiding head assembly and enables a handheld operation of each debraiding head assembly by a user gripping the grip portion, and further in which the length of braided hair is positioned within the space of the main body of each debraiding head assembly, the driving assembly causing a rotation of the debraiding wheel of each debraiding head assembly with respect to the main body about the wheel rotation axis, and the length of braided hair is engaged by the plurality of hooks of the rotating, debraiding wheel to unravel the length of braided hair.

2. The braid removal device of claim 1, wherein each main body of the one or more debraiding head assemblies comprises a front opening, a left side opening and a right side opening, the left and right side openings extending from opposite ends of and at an angle with the front opening, wherein the front opening and left and right side openings provide access to the space of the main body, and further wherein, in the working configuration, the length of braided hair extends through the front and left and right side openings.

3. The braid removal device of claim 2, wherein each main body of the one or more debraiding head assemblies is rectangular, and the left and right side openings are substantially perpendicular to the front opening.

4. The braid removal device of claim 2, wherein, in the working configuration, the braid removal device is configured such that the length of braided hair is displaceable along a transverse direction generally perpendicular to the wheel rotation axis and is displaceable through the left and right side openings, along the space and along the front opening.

5. The braid removal device of claim 1, wherein the main body of each debraiding head assembly comprises first and second body portions attached to one another in a clamshell configuration, the space defined between the first and second body portions.

6. The braid removal device of claim 5, wherein the first and second body portions are pivotable with respect to one another to vary a size of the space.

7. The braid removal device of claim 1, wherein the one or more debraiding head assemblies are disconnectably mountable to the grip portion.

8. The braid removal device of claim 7, wherein the one or more debraiding head assemblies comprise two or more debraiding head assemblies interchangeably mountable to the grip portion.

9. The braid removal device of claim 8, wherein the plurality of hooks of a respective debraiding wheel of each debraiding head assembly of the two or more debraiding head assemblies has a different configuration than the plurality of hooks of the respective debraiding wheel of another debraiding head assembly of the two or more debraiding head assemblies.

10. The braid removal device of claim 1, wherein each rotatable disk of the one or more debraiding head assemblies comprises a central hub, and the grip portion comprises a motor and a drive shaft, the drive shaft configured to be rotated by the motor and wherein the drive shaft is non-rotationally mountable to the central hub, and further wherein, in the working configuration, the drive shaft is non-rotationally mounted to the central hub and the rotatable disk is rotationally driven by the motor via the drive shaft and the central hub.

11. The braid removal device of claim 10, wherein the drive shaft is disconnectably mountable to the central hub.

12. The braid removal device of claim 10, wherein the grip portion is configured to receive at least one battery configured to electrically power the motor in the working configuration.

13. The braid removal device of claim 1, wherein the debraiding wheel of each debraiding head assembly is mountable to the main body of each debraiding head assembly entirely within the space of the main body, and further wherein, in the working configuration, the rotatable disk and the plurality of hooks are jointly rotatable entirely within the space of the main body of each debraiding head assembly.

14. The braid removal device of claim 1, wherein the plurality of curved hooks are curved forward in a direction of rotation of the debraiding wheel with respect to the wheel rotation axis, and further wherein, in the working configuration, the debraiding wheel of each debraiding head assembly rotates about the wheel rotation axis in said direction of rotation.

15. The braid removal device of claim 1, wherein the plurality of curved hooks are angularly spaced apart with one another along a periphery of the rotatable disk about the wheel rotation axis.

16. The braid removal device of claim 1, wherein the grip portion is elongate and formed along a longitudinal direction which is parallel to the wheel rotation axis in the working configuration.

17. The braid removal device of claim 16, wherein the grip portion is cylindrical and formed along a central longitudinal axis which is the same as the wheel rotation axis.

18. The braid removal device of claim 1, further comprising a controller and at least one speed sensor, wherein the speed sensor is configured to sense a speed of rotation of the debraiding wheel with respect to the main body about the wheel rotation axis, and further wherein the controller is configured to stop said rotation of the debraiding wheel of each debraiding head assembly responsively to detecting that the speed sensor has sensed a speed of rotation less than a predetermined threshold.

19. A braid removal device for unraveling bundles of hair formed into a length of braided hair, the braid removal device comprising:

one or more debraiding head assemblies, each debraiding head assembly comprising:

a main body defining a space for receipt of a length of braided hair, and a debraiding wheel, comprising a rotatable disk and a plurality of curved hooks extending radially outwardly from the rotatable disk, the debraiding wheel rotatably mountable to the main body at least partially within the space of the main body such that the rotatable disk and the plurality of hooks are jointly rotatable with respect to the main body in a direction of rotation about a wheel rotation axis, wherein the plurality of curved hooks are curved forward in the direction of rotation and are angularly spaced apart with one another along a periphery of the rotatable disk about the wheel rotation axis;

a driving assembly, configured to drive the debraiding wheel rotationally about the wheel rotation axis; and a grip portion, mountable to each debraiding head assembly of the one or more debraiding head assemblies;

wherein during use, the braid removal device is configured to adopt a working configuration in which each debraiding wheel of the one or more debraiding head assemblies is rotatably mounted to the main body of a respective one or the one or more debraiding head assemblies and the grip portion is mounted to each debraiding head assembly such that the grip portion carries each debraiding head assembly and enables a handheld operation of each debraiding head assembly by a user gripping the grip portion, and further in which the length of braided hair is positioned within the space of the main body of each debraiding head assembly, the driving assembly causing a rotation of the debraiding wheel of each debraiding head assembly with respect to the main body in the direction of rotation about the wheel rotation axis, and the length of braided hair is engaged by the plurality of hooks of the rotating, debraiding wheel to unravel the length of braided hair.

20. A braid removal device for unraveling bundles of hair formed into a length of braided hair, the braid removal device comprising:

one or more debraiding head assemblies, each debraiding head assembly comprising:

a main body defining a space for receipt of a length of braided hair, and a debraiding wheel, comprising a rotatable disk and a plurality of curved hooks extending radially outwardly from the rotatable disk, the debraiding wheel rotatably mountable to the main body at least partially within the space of the main body such that the rotatable disk and the plurality of hooks are jointly rotatable with respect to the main body in a direction of rotation about a wheel rotation axis, wherein the plurality of curved hooks are curved forward in the direction of rotation and are angularly spaced apart with one another along a periphery of the rotatable disk about the wheel rotation axis;

a driving assembly, configured to drive the debraiding wheel rotationally about the wheel rotation axis; and a grip portion, mountable to each debraiding head assembly of the one or more debraiding head assemblies, wherein the grip portion is elongate and formed along a longitudinal direction;

wherein during use, the braid removal device is configured to adopt a working configuration in which each debraiding wheel of the one or more debraiding head assemblies is rotatably mounted to the main body of a respective one of the one or more debraiding head assemblies and the grip portion is mounted to each debraiding head assembly, with the longitudinal direction parallel to the wheel rotation axis, such that the grip portion carries each debraiding head assembly and enables a handheld operation of each debraiding head assembly by a user gripping the grip portion, and further in which the length of braided hair is positioned within the space of the main body of each debraiding head assembly, the driving assembly causing a rotation of the debraiding wheel of each debraiding head assembly with respect to the main body in the direction of rotation about the wheel rotation axis, and the length of braided hair is engaged by the plurality of hooks of the rotating, debraiding wheel to unravel the length of braided hair.

* * * * *